US011136162B2

(12) United States Patent
Foushee

(10) Patent No.: US 11,136,162 B2
(45) Date of Patent: Oct. 5, 2021

(54) CONTAINER HAVING A PUSH-IN LOCKING DEVICE AND BLANK THEREFOR

(71) Applicant: WestRock Shared Services, LLC, Atlanta, GA (US)

(72) Inventor: Fred S. Foushee, Suwanee, GA (US)

(73) Assignee: WESTROCK SHARED SERVICES, LLC, Atlanta, GA (US)

( * ) Notice: Subject to any disclaimer, the term of this patent is extended or adjusted under 35 U.S.C. 154(b) by 127 days.

(21) Appl. No.: 16/271,951

(22) Filed: Feb. 11, 2019

(65) Prior Publication Data

US 2019/0248536 A1 Aug. 15, 2019

Related U.S. Application Data

(60) Provisional application No. 62/629,925, filed on Feb. 13, 2018.

(51) Int. Cl.

| | |
|---|---|
| ***B65D 5/20*** | (2006.01) |
| ***B65D 5/42*** | (2006.01) |
| ***B31B 50/73*** | (2017.01) |
| *B31B 110/35* | (2017.01) |
| *B31B 120/10* | (2017.01) |
| *B31B 120/70* | (2017.01) |

(Continued)

(52) U.S. Cl.

CPC ..... *B65D 5/2057* (2013.01); *B31B 50/732* (2017.08); *B65D 5/4266* (2013.01); *B31B 50/88* (2017.08); *B31B 2110/35* (2017.08); *B31B 2120/102* (2017.08); *B31B 2120/302* (2017.08); *B31B 2120/70* (2017.08)

(58) Field of Classification Search

CPC .. B65D 5/6664; B65D 5/0254; B65D 5/6608; B65D 5/665; B65D 5/68; B65D 5/2057; B65D 5/2054; B65D 5/10–106; B65D 5/6635; B65D 5/6655; B65D 5/685; B31B 50/732–734; B31B 2120/102; B31B 2120/70; B31B 2110/35

USPC ..... 229/148, 149, 152, 125.28, 126, 103.2, 229/232, 125.19, 125.27, 141; 220/834–835, 4.21–4.25

See application file for complete search history.

(56) References Cited

U.S. PATENT DOCUMENTS 4,232,816 A * 11/1980 Johnson ..... B65D 5/2047 206/831

5,060,851 A * 10/1991 Lorenz ..... B65D 5/2047 220/4.24

(Continued)

*Primary Examiner* — Nathan J Newhouse

*Assistant Examiner* — Phillip D Schmidt

(74) *Attorney, Agent, or Firm* — Brian J. Goldberg

(57) ABSTRACT

A container formed from at least one blank of sheet material includes a tray, a cover configured to close the tray, and a locking device. The tray includes a tray front panel. The cover includes a cover front panel that extends downwardly from a front edge of a cover top panel. The cover front panel is configured to be positioned in an at-least partially overlapping arrangement with the tray front panel when the cover is closed. The locking device includes a locking tab hingedly attached to the cover top panel and struck in part from the cover top panel and in part from the cover front panel. The locking device also includes a locking recess struck from an upper edge of the tray front panel. The locking device is configured such that the locking tab can be pressed down into the locking recess to selectively secure the cover to the tray in a closed and locked configuration.

19 Claims, 2 Drawing Sheets

(51) Int. Cl.
*B31B 50/88* (2017.01)
*B31B 120/30* (2017.01)

(56) References Cited

U.S. PATENT DOCUMENTS

| | | | | | |
|---|---|---|---|---|---|
| 5,431,333 | A * | 7/1995 | Lorenz | B65D 5/2047 | 229/114 |
| 5,791,554 | A * | 8/1998 | Jensen | B65D 5/665 | 229/108 |
| 6,223,979 | B1 * | 5/2001 | Correll | B65D 5/6655 | 229/114 |
| 6,299,059 | B1 * | 10/2001 | Bernstein | B65D 5/4279 | 229/115 |
| 8,061,585 | B2 * | 11/2011 | Nikolai | B65D 5/28 | 229/126 |
| 2017/0297802 | A1 * | 10/2017 | Davis | B65D 43/16 | |
| 2017/0313464 | A1 * | 11/2017 | Mccarthy | B65D 5/0254 | |

* cited by examiner

CONTAINER HAVING A PUSH-IN LOCKING DEVICE AND BLANK THEREFOR

REFERENCE TO RELATED APPLICATION

This application claims the benefit of priority under 35 U.S.C. § 119(e) of U.S. provisional application Ser. No. 62/629,925 filed on Feb. 13, 2018, which is hereby incorporated by reference in its entirety.

BACKGROUND

The field of the invention relates generally to containers and blanks. More specifically the field of the invention relates to a folded paperboard container or the like and blank therefor having a push-in lock for securing a container lid or cover to a container tray.

Folded paperboard containers and the like are used in a variety of industries. Many such containers include a tray and cover therefor. In some applications, it is desirable to provide such a container with a locking mechanism that allows the cover to be securely attached to the tray. Current locking mechanisms for use with such containers suffer from certain limitations. In particular, they may be difficult to engage and disengage. Accordingly, it is an object of at least one aspect of the present invention to provide a container and blank therefor with a locking mechanism that solves or mitigate the problems associated with the prior art.

SUMMARY

According to a first aspect of the invention, there is provided a container formed from at least one blank of sheet material. The container includes a tray having a tray front panel and a cover configured to close the tray. The cover includes a cover top panel and a cover front panel that extends downwardly from a front edge of the cover top panel. The cover front panel is configured to be positioned in an at-least partially overlapping arrangement with the tray front panel when the cover is closed. The container also includes a locking device that includes a locking tab hingedly attached to the cover top panel and struck in part from the cover top panel and in part from the cover front panel. The locking device further includes a locking recess struck from an upper edge of the tray front panel. The locking device is configured such that the locking tab can be pressed down into the locking recess to selectively secure the cover to the tray in a closed and locked configuration.

Optionally, the locking can be configured to engage the locking recess in a friction-fit manner that resists separation.

Optionally, the locking recess can include side edges that taper outwardly moving from the upper edge of the tray front panel toward a bottom edge of the locking recess.

Optionally, the locking tab can be hingedly attached to the cover top panel via a fold line. The locking tab can include side edges that taper outwardly as they extend away from the fold line.

Optionally, the locking can include a convex front edge.

Optionally, the container can be a six corner beers tray.

Optionally, the cover can be integrally formed with the tray.

According to a second aspect of the invention, there is provided a blank of sheet material for forming a container. The blank includes a tray-forming portion configured to form a tray in a set-up container. The tray-forming portion includes a tray front panel. The blank further includes a cover-forming portion configured to form a cover for closing the tray in the set-up container. The cover-forming portion includes a cover top panel and a cover front panel hingedly connected to the cover top panel. The cover front panel is configured to be positioned in an at-least partially overlapping arrangement with the tray front panel when the cover is closed. The blank includes a locking device that includes a locking tab hingedly attached to the cover top panel and struck in part from the cover top panel and in part from the cover front panel. The locking device also includes a locking recess struck from an upper edge of the tray front panel. The locking device is configured in the set-up container such that the locking tab can be pressed down into the locking recess to selectively secure the cover to the tray in a closed and locked configuration.

Optionally, the locking tab is configured to engage the locking recess in a friction-fit manner that resists separation.

Optionally, the locking recess includes side edges that taper outwardly moving from the upper edge of the tray front panel toward a bottom edge of the locking recess.

Optionally, the locking tab is hingedly attached to the cover top panel via a fold line, and the locking tab includes side edges that taper outwardly as they extend away from the fold line.

Optionally, the locking tab has a convex front edge.

Optionally, the set-up container is a six corner beers tray.

BRIEF DESCRIPTION OF THE DRAWINGS

Exemplary embodiments of the invention will now be described with reference to the accompanying drawings, in which.

DETAILED DESCRIPTION

Detailed descriptions of specific embodiments of cartons and blanks are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the cartons and blanks described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the term "container" or "carton" refers, for the non-limiting purpose of illustrating the various features of the invention, to a container for transporting, storing, and/or dispensing articles. It is contemplated that the teachings of the invention can be applied to various containers suitable for carrying a wide variety of articles.

Figure 1:
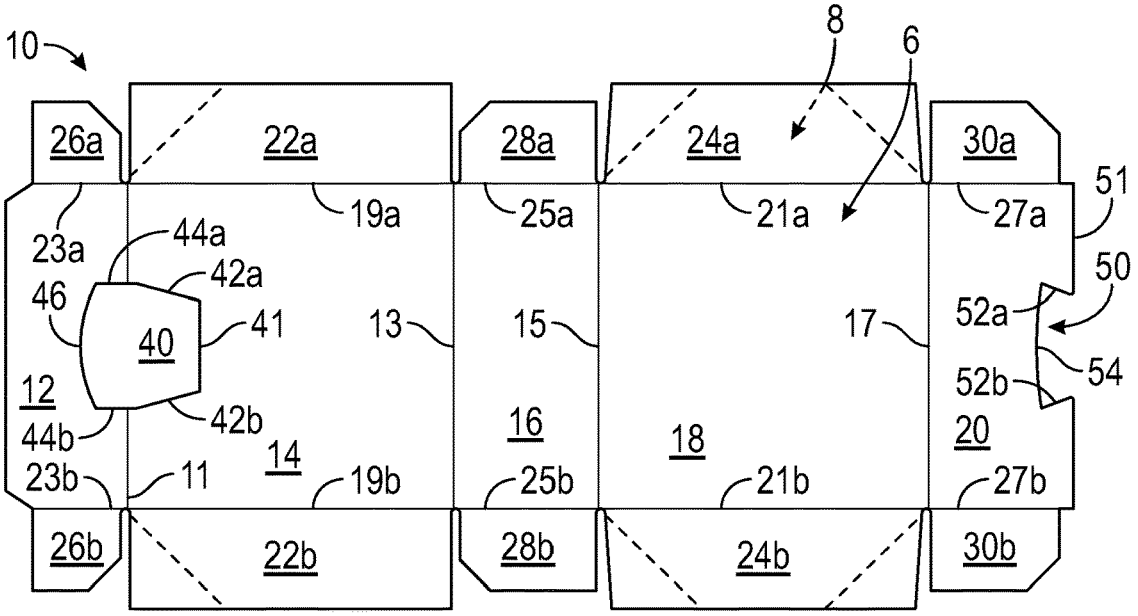
FIG. 1 is a top plan view of an exemplary blank of sheet material according to a first embodiment of the invention.
Figure 2:
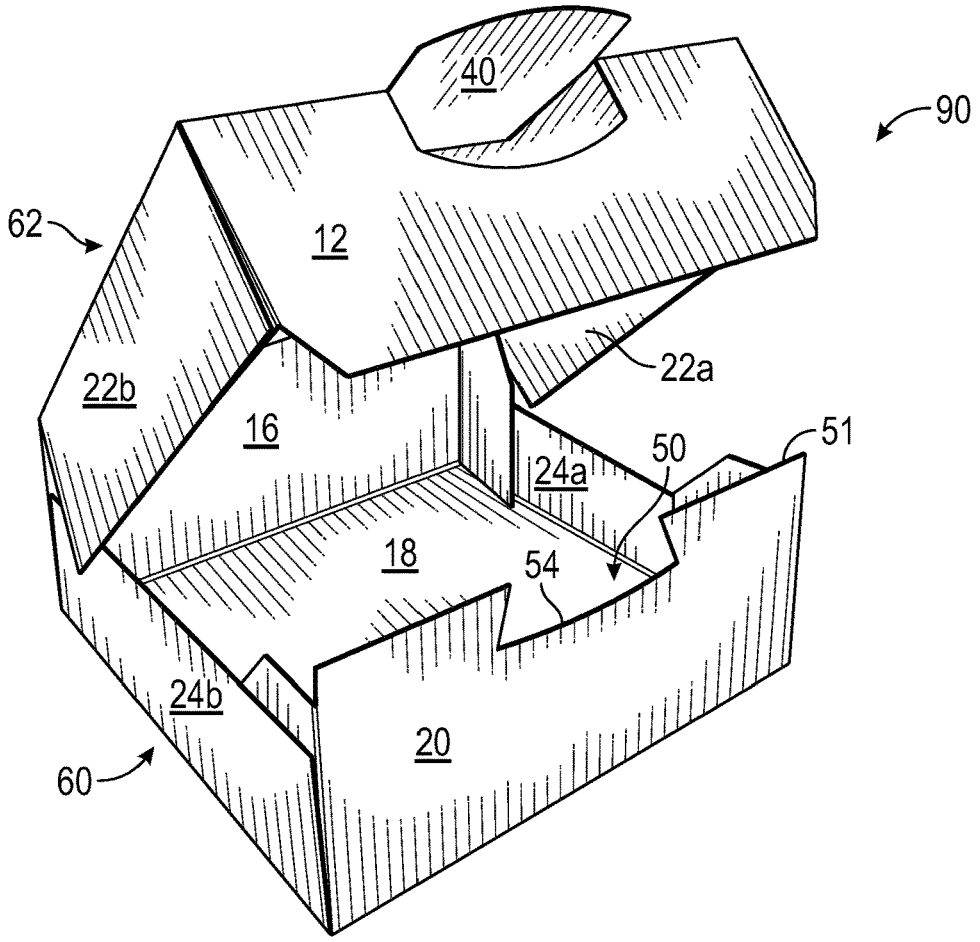
FIG. 2 is a perspective view of a carton formed from the blank of FIG. 1 with its lid in an open configuration.
Figure 3:
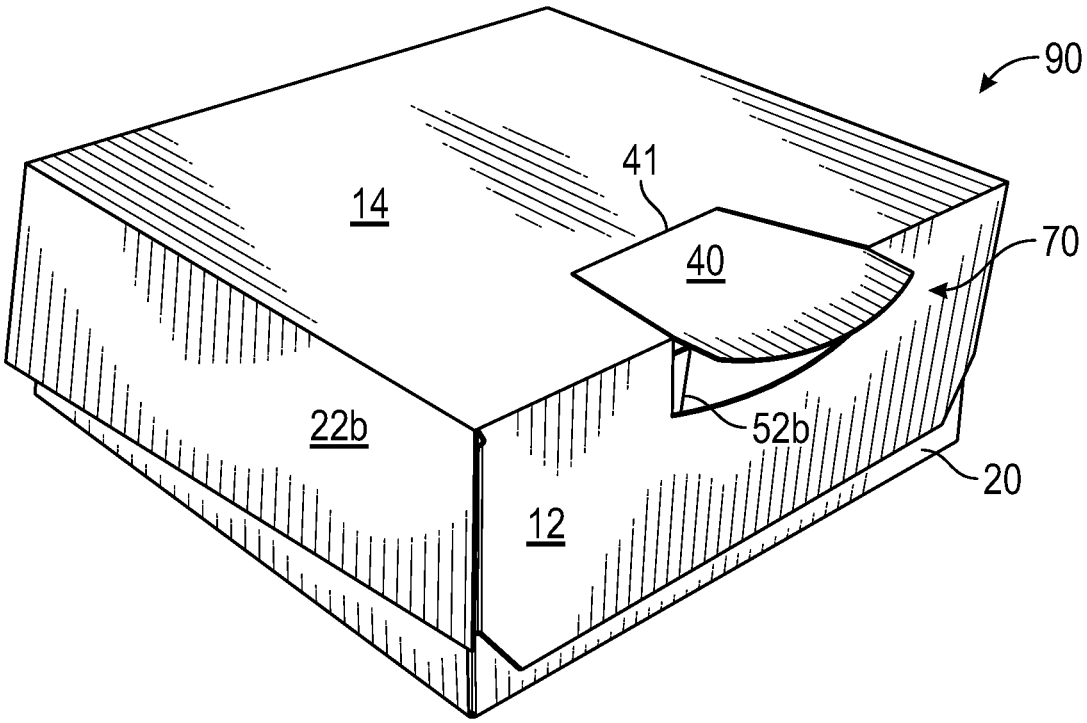
FIG. 3 is a perspective view of the carton of FIG. 2 with its lid in a closed, unlocked configuration.
Figure 4:
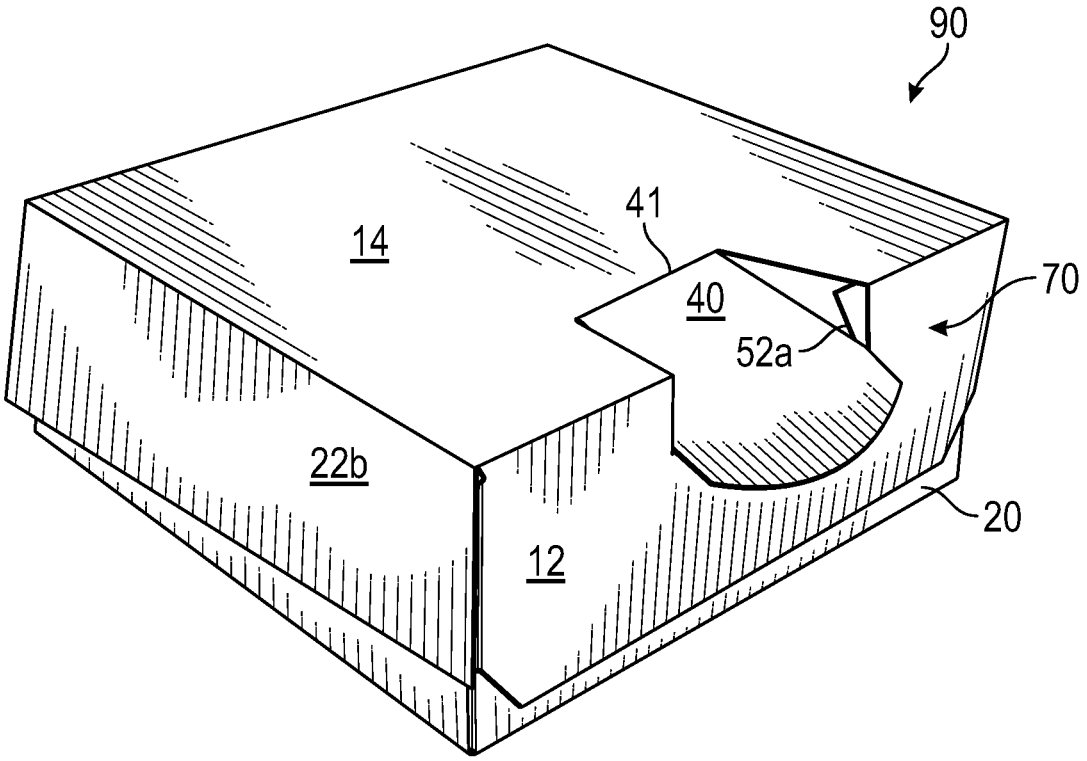
FIG. 4 is a perspective view of the carton of FIG. 2 with its lid in a closed, locked configuration.

Referring to FIG. 1, there is shown a first blank 10 for forming a carton 90 (see FIGS. 2-4). The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, for example, to provide the cartons described in more detail below.

In the illustrated embodiment, carton 90 is in the style of a six corner beers tray. Carton 90 has a tray portion 60 with a hinged lid 62. Lid 62 can be releasably secured to the tray 60 via a locking device 70 that will be described in more detail below.

In one or more embodiments, blank 10 can be formed from a paperboard, corrugated board, or cardboard in which one or both sides of the blank, is printed and/or treated with one or more coatings, such as for example, one or more waterproof coatings and/or one or more coatings designed to provide a smooth and/or visually-attractive surface (e.g., a white or other colored surface). In one or more embodiments, informational or promotional material such as, e.g., a brand name or logo, can be printed on a treated side.

Referring to FIG. 1, blank 10 has a first or interior surface 6 and a second or exterior surface 8. Blank 10 includes a cover front panel 12 hingedly connected to a cover top panel 14 via transverse fold line 11. Cover top panel 14 is hingedly connected to a tray rear panel 16 via transverse fold line 13. Tray rear panel 16 is hingedly connected to a tray bottom panel 18 via transverse fold line 15. Tray bottom panel 18 is hingedly connected to a tray front panel 20 via transverse fold line 17. First and second cover end panels 22*a*, 22*b* are hingedly connected along opposite end edges of cover top panel 14 via respective longitudinal fold lines 19*a*, 19*b*. First and second tray end panels 24*a*, 24*b* are hingedly connected along opposite end edges of tray bottom panel 18 via respective longitudinal fold lines 21*a*, 21*b*. Glue flaps 26*a*, 26*b* are hingedly connected along opposite end edges of cover front panel 12 via respective longitudinal fold lines 23*a*, 23*b*. Glue flaps 28*a*, 28*b* are hingedly connected along opposite end edges of tray rear panel 16 via respective longitudinal fold lines 25*a*, 25*b*. Glue flaps 30*a*, 30*b* are hingedly connected along opposite end edges of tray front panel 20 via respective longitudinal fold lines 25*a*, 25*b*.

A locking tab 40 is struck in part from cover front panel 12 and in part from cover top panel 14. Locking tab 40 is hingedly connected to cover top panel 14 via transverse fold line 41 disposed in cover tray panel 14. Cut lines 42*a*, 44*a* and 42*b*, 44*b* define respective first and second side edges of locking tab 40. In the illustrated embodiment, cut lines 42*a*, 42*b* taper outward slightly as they extend from opposite ends of fold line 41 toward cut lines 44*a*, 44*b*. Cut lines 44*a*, 44*b* interrupt and are generally perpendicular to fold line 11. A generally transverse cut line 46 disposed in cover front panel 12 extends between the end points of cut lines 44*a*, 44*b* and defines an outer or front edge of the locking tab 40. In the illustrated embodiment, cut line 46 is slightly rounded, giving the front edge of locking tab 40 a convex shape. In other embodiments, locking tab 40 can have a different shape than that shown.

A locking recess 50 is struck from the outer or, relative to the erected container 90, "upper," edge 51 of tray front panel 20. Locking recess is defined by respective first and second side edges 52*a*, 52*b* and bottom edge 54. Preferably, side edges 52*a*, 52*b* taper outwardly as they extend from upper edge 51 toward bottom edge 54. Thus, in the illustrated embodiment, locking recess 50 becomes wider moving from upper edge 51 toward bottom edge 54. Locking recess 50 is sized and positioned so as to be capable of selectively receiving locking tab 40 to secure the container lid 62 to the container tray 60.

FIG. 2 shows container 90 with its lid 62 in an open configuration. To secure the lid in place, the lid 62 is first lowered down over the tray 60 to close the container, resulting in the configuration shown in FIG. 3. In this configuration, the locking tab 40 remains generally in a plane defined by cover top panel 14. To engage the locking device 70, the locking tab 40 can be pushed downward, rotating the locking tab 40 about fold line 41 and causing an end portion of the locking tab 40 to be received within locking recess 50 as shown in FIG. 4. Locking tab 40 and locking recess 50 are sized and configured such that the locking tab engages the locking recess in a friction-fit manner that resists separation. Pressing the locking tab 40 into the locking recess 50 may cause the locking tab's side edges to bow upward at least slightly as a result of their engagement with the side edges 52*a*, 52*b* of locking recess 50. To disengage the locking device 70, the locking tab 50 is simply pulled or pushed upward and out of engagement with the locking recess 40.

The configuration of the disclosed blank 10 and carton 90 may provide certain advantages over other cartons having locking features. In particular, locking device 70 is simple to manufacture and use and can be easily and reliably engaged and disengaged by a user using only hand.

Exemplary embodiments of blanks and methods for forming containers are described above in detail. The apparatus and methods are not limited to the specific embodiments described herein, but rather, components of apparatus and/or steps of the methods may be utilized independently and separately from other components and/or steps described herein. For example, in the illustrated embodiment, locking device 70 is used in connection with a carton 90 is in the style of a six corner beers tray. However, locking device 70 is suitable for use with a wide variety of lidded containers. For example, in other embodiments, locking device 70 may be used with a container having a lid that is completely separable from the tray. In such embodiments, a plurality of locking devices may be provided, e.g., four locking devices, each disposed on a different side of a rectangular container. In other embodiments, a plurality of locking devices may be spaced apart from one another along a single side of a container. As another example, in the illustrated embodiment, cover front panel 12 is configured to fit over tray front panel 20. In other embodiments, however, cover front panel may be a tuck flap that is configured to be positioned behind tray front panel when the lid is closed.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A container formed from at least one blank of sheet material, the container comprising:

a tray comprising a tray front panel;

a cover configured to close the tray, the cover comprising a cover top panel and a cover front panel that extends downwardly from a front edge of the cover top panel, the cover front panel configured to be positioned in an at-least partially overlapping arrangement with the tray front panel when the cover is closed; and a locking device comprising a locking tab hingedly attached to the cover top panel by a fold line and struck in part from the cover top panel and in part from the cover front panel, the locking device further comprising a locking recess struck from an upper edge of the tray front panel, the locking recess comprising a free edge at an upper end thereof to allow the locking tab to enter and engage with the locking recess;

wherein the locking device is configured such that the locking tab can be pressed down into the locking recess to selectively secure the cover to the tray in a closed and locked configuration by rotating the locking tab about the fold line so that, where the locking tab meets the cover top panel at the fold line, an oblique angle is formed between the cover top panel and a top face of the locking tab in the closed and locked configuration.

2. The container according to claim 1, wherein the locking tab is configured to engage the locking recess in a friction-fit manner that resists separation.

3. The container according to claim 1, wherein the locking recess comprises side edges that taper outwardly moving from the upper edge of the tray front panel toward a bottom edge of the locking recess.

4. The container according to claim 1, wherein the locking tab comprises side edges that taper outwardly as they extend away from the fold line.

5. The container according to claim 4, wherein a maximum width of the locking tab between the side edges that taper outwardly is greater than a width of the locking recess, and the side edges of the locking tab are configured to engage with side edges of the locking recess in the closed and locked configuration.

6. The container according to claim 1, wherein the locking tab has a convex front edge.

7. The container according to claim 1, wherein the container comprises a tray comprising the cover, the tray front panel, a tray rear panel, a tray bottom panel, and a pair of tray side panels.

8. The container according to claim 1, wherein the cover is integrally formed with the tray.

9. The container according to claim 1, wherein side edges of the locking tab are configured to bow upward in the closed and locked configuration.

10. The container according to claim 1, wherein the fold line is offset from a front edge of the cover top panel by a distance that is greater than half of a longitudinal length of the locking tab.

11. A blank of sheet material for forming a container, the blank comprising:

a tray-forming portion configured to form a tray in a set-up container, the tray-forming portion comprising a tray front panel;

a cover-forming portion configured to form a cover for closing the tray in the set-up container, the cover-forming portion comprising a cover top panel and a cover front panel hingedly connected to the cover top panel, the cover front panel configured to be positioned in an at-least partially overlapping arrangement with the tray front panel when the cover is closed; and a locking device comprising a locking tab hingedly attached to the cover top panel and struck in part from the cover top panel and in part from the cover front panel, the locking device further comprising a locking recess struck from an upper edge of the tray front panel, the locking recess comprising a free edge at an outer end thereof to allow the locking tab to enter and engage with the locking recess in the set-up container;

wherein the locking device is configured in the set-up container such that the locking tab can be pressed down into the locking recess to selectively secure the cover to the tray in a closed and locked configuration.

12. The blank according to claim 11, wherein the locking tab is configured to engage the locking recess in a friction-fit manner that resists separation.

13. The blank according to claim 11, wherein the locking recess comprises side edges that taper outwardly moving from the upper edge of the tray front panel toward a bottom edge of the locking recess.

14. The blank according to claim 11, wherein the locking tab is hingedly attached to the cover top panel via a fold line, and wherein the locking tab comprises side edges that taper outwardly as they extend away from the fold line.

15. The blank according to claim 14, wherein a maximum width of the locking tab between the side edges that taper outwardly is greater than a width of the locking recess, and the side edges of the locking tab are configured to engage with side edges of the locking recess in the closed and locked configuration.

16. The blank according to claim 11, wherein the locking tab has a convex front edge.

17. The blank according to claim 11, wherein the set-up container comprises a tray comprising the cover, the tray front panel, a tray rear panel, a tray bottom panel, and a pair of tray side panels.

18. The blank according to claim 11, wherein side edges of the locking tab are configured to bow upward in the closed and locked configuration.

19. The blank according to claim 11, wherein the locking tab is hingedly attached to the cover top panel by a fold line that is offset from a front edge of the cover top panel by a distance that is greater than half of a longitudinal length of the locking tab.

* * * * *